US009064430B2

(12) United States Patent
Burout, III et al.

(10) Patent No.: US 9,064,430 B2
(45) Date of Patent: Jun. 23, 2015

(54) FASTENING ASSEMBLY FABRICATED FROM A WATER-SOLUBLE MATERIAL AND RELATED METHODS

(75) Inventors: Charles J. Burout, III, Bedford, NH (US); Thomas Shilale, Douglas, MA (US)

(73) Assignee: Avery Dennison Corporation, Glendale, CA (US)

( * ) Notice: Subject to any disclaimer, the term of this patent is extended or adjusted under 35 U.S.C. 154(b) by 973 days.

(21) Appl. No.: 12/684,824

(22) Filed: Jan. 8, 2010

(65) Prior Publication Data

US 2010/0175227 A1 Jul. 15, 2010

Related U.S. Application Data

(60) Provisional application No. 61/144,104, filed on Jan. 12, 2009.

(51) Int. Cl.

| | |
|---|---|
| ***B65D 63/00*** | (2006.01) |
| ***F16B 15/00*** | (2006.01) |
| ***G09F 3/12*** | (2006.01) |
| ***G09F 3/14*** | (2006.01) |

(52) U.S. Cl.

CPC ..... *G09F 3/12* (2013.01); *Y10T 24/1498* (2015.01); *G09F 3/14* (2013.01)

(58) Field of Classification Search

USPC ..... 524/56, 503, 557, 803; 525/56; 427/402; 411/457; 24/16 PB

See application file for complete search history.

(56) References Cited

U.S. PATENT DOCUMENTS

| | | | | |
|---|---|---|---|---|
| 3,766,608 | A | 10/1973 | Fay | |
| 3,848,556 | A * | 11/1974 | Terada et al. | 112/475.16 |
| 4,039,078 | A | 8/1977 | Bone | |
| 4,347,648 | A | 9/1982 | Dekkers | |
| 4,462,784 | A | 7/1984 | Russell | |
| 4,658,478 | A | 4/1987 | Paradis | |
| 4,754,529 | A | 7/1988 | Paradis | |
| 4,866,816 | A | 9/1989 | Caveney | |
| 4,955,475 | A | 9/1990 | McCarthy et al. | |
| 5,234,615 | A * | 8/1993 | Gladfelter et al. | 510/439 |
| 5,593,630 | A | 1/1997 | Sorensen et al. | |
| 5,669,111 | A | 9/1997 | Rohaly | |
| 5,860,194 | A * | 1/1999 | Takizawa et al. | 24/452 |
| 5,930,876 | A * | 8/1999 | Takizawa et al. | 24/452 |
| 5,985,406 | A * | 11/1999 | Takizawa et al. | 428/99 |

(Continued)

FOREIGN PATENT DOCUMENTS

| | | |
|---|---|---|
| GB | 2411205 | 8/2005 |
| JP | 11-1951 | 1/1999 |

(Continued)

OTHER PUBLICATIONS

Polyvinyl Alcohol [online]. Rastogi Trading Company [retrived on Oct. 10, 2013]. Retrieved from the Internet: <URL: http://rtcompany.tripod.com/id47.html>.*

(Continued)

*Primary Examiner* — Robert J Sandy
*Assistant Examiner* — Louis Mercado
(74) *Attorney, Agent, or Firm* — Avery Dennison Retail Information Services LLC

(57) ABSTRACT

A fastening assembly that has an item made of, or that includes, a water-soluble material; and related methods for manufacturing, or dissolving or weakening, the fastening assembly, which has at least one water-soluble portion that includes the water-soluble material.

17 Claims, 6 Drawing Sheets

(56) References Cited

U.S. PATENT DOCUMENTS

| | | | | |
|---|---|---|---|---|
| 6,063,067 | A * | 5/2000 | Takizawa et al. | 604/386 |
| 7,497,623 | B2 * | 3/2009 | Thomas et al. | 383/63 |
| 2003/0045856 | A1 * | 3/2003 | Couture et al. | 604/391 |
| 2004/0210167 | A1 | 10/2004 | Webster | |

FOREIGN PATENT DOCUMENTS

| | | |
|---|---|---|
| JP | 2006-325939 | 12/2006 |
| WO | 2007/047620 | 4/2007 |

OTHER PUBLICATIONS

Product information on polyvinyl alcohol preparations [online]. Zschimmer & Schwarz GmbH & Co KG—Chemische Fabriken [retrived on Oct. 10, 2013]. Retrieved from the Internet: <URL:http://www.tandem-chemical.com/principles/zschimmer/ceramics_aux/special_info/E_PVAzubereitungen%5B1%5D.pdf.*

International Search Report and Written Opinion dated Mar. 26, 2010 from corresponding International Application No. PCT/US2010/020550.

* cited by examiner

FASTENING ASSEMBLY FABRICATED FROM A WATER-SOLUBLE MATERIAL AND RELATED METHODS

CROSS-REFERENCE TO RELATED APPLICATION

Priority is claimed to U.S. Provisional Patent Application No. 61/144,104, filed on Jan. 12, 2009, entitled "Fastening Assembly Fabricated From a Water-soluble Material and Related Methods," by Charles J. Burout and Thomas Shilale, which application is incorporated by reference herein.

FIELD OF THE INVENTION

The invention relates generally to the field of fastening assemblies. More specifically, the invention relates to fastening assemblies that are fabricated from, or include, a water-soluble material.

BACKGROUND

Currently, fastening assemblies, e.g., fasteners, staples, and cable ties, which are used to attach tags to articles of commerce, also known as merchandise, and/or to bind items together, are made from conventional polymers. Examples of these conventional polymers include the following: polyurethanes ("PUs"), polyethylenes ("PEs"), polypropylenes ("PPs"), and polyamides ("PAs"). In some instances, manufacturers use fastening assemblies to temporarily fasten items together during a portion of the manufacturing process, or to temporarily couple a tag to an item. For example, some apparel manufactures use fastening assemblies to temporarily bind apparel together during various steps of the apparel's manufacturing process. Eventually, the fastening assembly is removed before the manufacturing process is completed, and the apparel is shipped for distribution.

It should, therefore, be appreciated that there is a need for fastening assemblies that are made of materials that are easily removed during the manufacturing process. The present invention satisfies this need.

SUMMARY

The present invention includes exemplary embodiments of a fastening assembly including an item that is made of, or includes, a water-soluble material, and related methods of manufacturing, or dissolving or weakening, such a fastening assembly. In other, more detailed features of the invention, the water-soluble material can be polyvinyl alcohol, a polyvinyl alcohol based polymer, ethylene vinyl alcohol, or an ethylene vinyl alcohol based polymer.

In other, more detailed features of the invention, the item is configured to dissolve or weaken at a faster rate when the item is exposed to a liquid that includes water having a temperature at or above a threshold temperature, than when the item is exposed to the liquid that includes water having a temperature below the threshold temperature. In addition, the item can be configured to dissolve or weaken within a period of time when the item is exposed to a liquid that includes water having a temperature at or above a threshold temperature. The period of time can be up to approximately 60 minutes, up to approximately 40 minutes, or up to approximately 20 minutes. The threshold temperature can be up to approximately +60° C. Also, the threshold temperature can have a value from approximately +25° C. to approximately +100° C., from approximately +40° C. to approximately +100° C., from approximately +50° C. to approximately +100° C., or from approximately +60° C. to approximately +100° C.

In other, more detailed features of the invention, the fastening assembly is a fastener, a staple, or a cable tie. Also, the item can be a paddle, a crossbar, a filament, a strap, a head, a neck, a tang, a rail, or a tooth.

Another exemplary embodiment is a fastening assembly that includes an item having at least one water-soluble portion.

An exemplary method according to the invention is a method for manufacturing a fastening assembly having at least one water-soluble portion. The method includes providing a water-soluble material, and forming the at least one water-soluble portion of the fastening assembly from the water-soluble material.

Another exemplary method according to the invention is a method for dissolving or weakening at least one water-soluble portion of a fastening assembly where the at least one water-soluble portion includes a water-soluble material. The method includes providing the fastening assembly, and exposing the at least one water-soluble portion of the fastening assembly to a liquid that includes water.

In other, more detailed features of the invention, the at least one water-soluble portion is configured to dissolve or weaken at a faster rate when the at least one water-soluble portion is exposed to the liquid that includes water having a temperature at or above a threshold temperature, than when the at least one water-soluble portion is exposed to the liquid that includes water having a temperature below the threshold temperature. Also, the step of exposing the at least one water-soluble portion of the fastening assembly to a liquid that includes water can include exposing for a first period of time the at least one water-soluble portion to a first liquid that includes water at a first temperature that is below the threshold temperature so the at least one water-soluble portion does not completely dissolve or weaken, and exposing for a second period of time the at least one water-soluble portion to a second liquid that includes water at a second temperature that is at or above the threshold temperature so the at least one water-soluble portion does completely dissolve or weaken. Furthermore, the first liquid and the second liquid can be the same liquid. In addition, the at least one water-soluble portion can be configured to dissolve within a period of time when the at least one water-soluble portion is exposed to the liquid that includes water having a temperature at or above a threshold temperature.

Other features of the invention should become apparent to those skilled in the art from the following description of the preferred embodiments taken in conjunction with the accompanying drawings, which illustrate, by way of example, the principles of the invention, the invention not being limited to any particular preferred embodiment(s) disclosed.

BRIEF DESCRIPTION OF THE DRAWINGS

These and other features, aspects, and advantages of the present invention will become better understood with reference to the following description, appended claims, and accompanying drawings, where:

Unless otherwise indicated, the illustrations in the above figures are not necessarily drawn to scale.

DETAILED DESCRIPTION

The present invention is embodied in fastening assemblies, and related methods, that are made of, or include, water-soluble material, e.g., polyvinyl alcohol ("PVOH"), a PVOH-based polymer, ethylene vinyl alcohol ("EVOH"), or an EVOH-based polymer. Fastening assemblies come in a multitude of different mechanical configurations. A few non-limiting examples of fastening assemblies are discussed below.

Fasteners:

A first example of a fastening assembly is a fastener of the type used to attach a merchandise tag to a piece of fabric, such as an article of clothing, product label, and the like. This type of fastener typically includes items, for example, an elongated plastic member having a first end shaped to define a crossbar, also known as a "T-bar," a second end shaped to define an enlarged paddle, and a thin filament portion that interconnects the crossbar and the paddle. As will be described further below, the crossbar is adapted to be inserted first through the tag and then into the piece of fabric, with the paddle being appropriately sized and shaped to keep the tag from being pulled off the second end of the filament portion.

Figure 1:
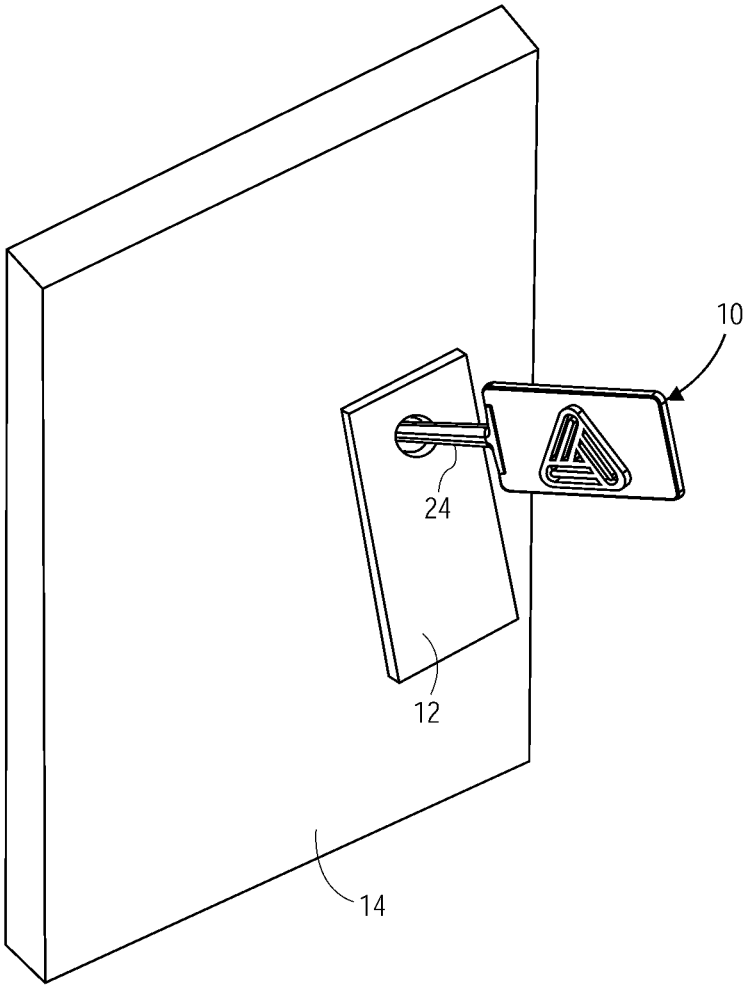
FIG. 1 is a perspective view of an example fastener being shown secured to an article of commerce and supporting a merchandise tag.

Referring now to FIG. 1, there is shown a first example embodiment of a fastener 10. The fastener is shown securing a merchandise tag 12 to an article of commerce 14. For the purposes of the present invention, the article of commerce represents any product that can be tagged with the fastener. As an example, the article of commerce can be an article of clothing, such as a shirt or a pair of socks, or a label, e.g., a woven label, affixed to the article of clothing. In another example, the article of commerce can be a rug or other similar length of fabric or material. In yet another example, the article of commerce can be a food product, e.g., cooked or uncooked chicken, beef, or fish, that is displayed for sale. It is to be understood that additional applications for a fastener to articles of commerce could be envisioned without departing from the spirit of the present invention.

Figure 2:
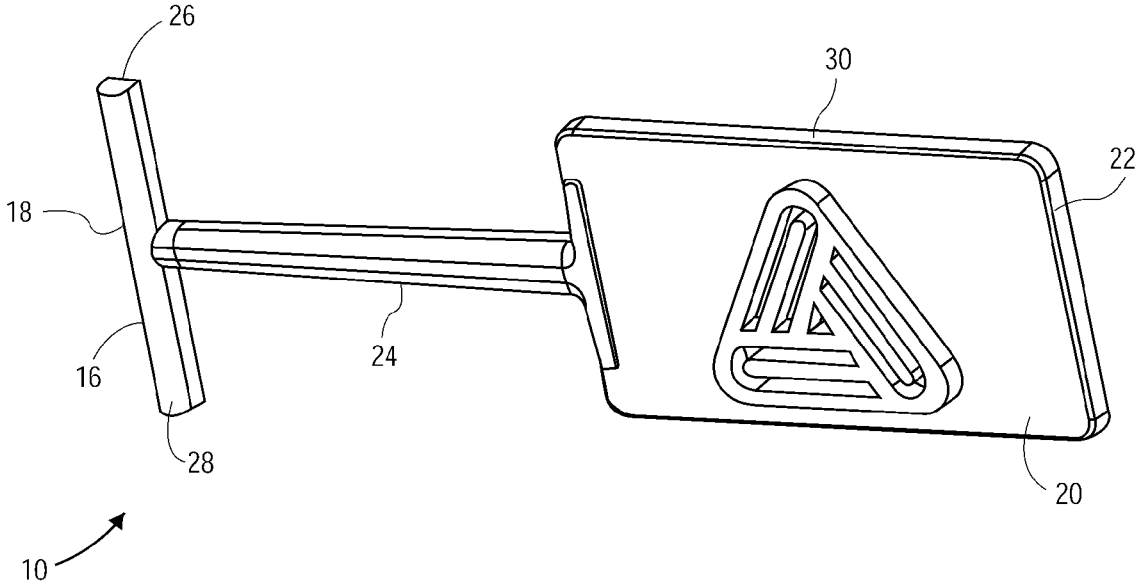
FIG. 2 is an enlarged perspective view of the fastener shown in FIG. 1.

Referring additionally to the enlarged perspective view shown in FIG. 2, the example fastener 10 is a unitary member having a first end 16, which is shaped to define a crossbar 18, a second end 20, which is shaped to define an enlarged paddle 22, and a thin filament 24, which interconnects the crossbar and the paddle. The crossbar is generally D-shaped in lateral cross-section, and includes a flat bottom surface 26 and a rounded top surface 28. As such, the crossbar is sized and shaped to be inserted through a merchandise tag 12 and into an article of commerce 14. The paddle is in the form of an enlarged, thin rectangular member 30 that has an appropriate size and shape to prevent a merchandise tag, which is slidably mounted on the filament (as shown in FIG. 1), from being removed.

Figure 3:
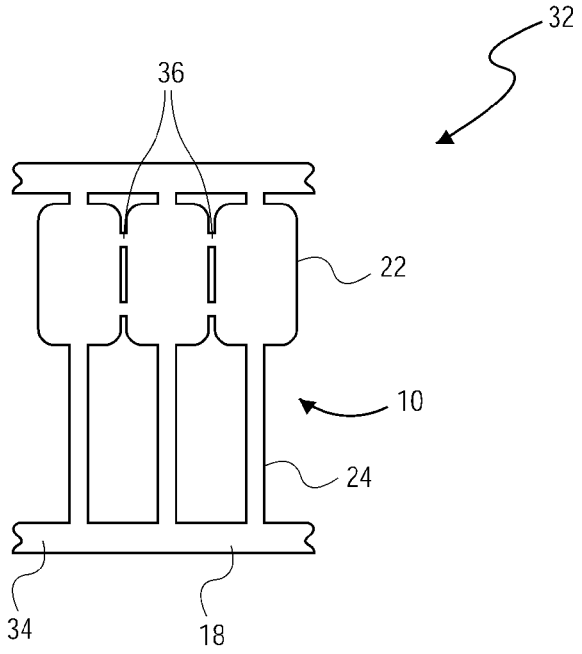
FIG. 3 is a top plan view of an example fastener stock that includes the fastener of FIG. 1.

Typically, fasteners 10 of the type described above are mass-produced in either one of two different forms known as fastener stock 32 (see FIG. 3). A first type of fastener stock is a clip-type assembly that includes a plurality of fasteners, where each fastener includes a flexible filament 24 having a crossbar 18 at one end 16 and a paddle 22 at the opposite end 20. The fasteners are arranged in a spaced, side-by-side orientation, with the respective crossbars parallel to one another and the respective paddles parallel to one another. The crossbars are joined together as part of a common, orthogonally-disposed runner bar 34. Adjacent paddles also may be interconnected by severable connectors 36. This first type of fastener stock can be formed using injection molding processes. Several commercial embodiments of the above-described fastener clip have been sold by the present assignee, Avery Dennison Corporation of Pasadena, Calif., as DENNISON® SWIFTACH® fastener clips.

A second type of fastener stock, which is shown in U.S. Pat. No. 4,955,475 to McCarthy et al. ("the McCarthy patent"), which is incorporated by reference herein in its entirety, includes a plurality of fasteners 10 arranged in an end-to-end alignment, where the paddles 22 and T-bars 18 of successive fasteners are joined together using severable connectors so as to form a supply of continuously connected fastener stock. This second type of fastener stock is commonly manufactured through a process that is referred to as "continuous molding". An example of continuously connected fastener stock that is manufactured using a process of continuous molding is disclosed in U.S. Pat. No. 4,462,784 to Russell ("the Russell patent"), which is incorporated by reference herein in its entirety. In the Russell patent, the continuously connected fastener stock is made using a rotary extrusion process that involves a rotating molding wheel whose periphery is provided with molding cavities that are complementary in shape to the molded fastener stock. To form the fastener stock, molten plastic is extruded into the cavities of the molding wheel with a layer of controlled film overlying the peripheral impression. The molten plastic is then allowed to solidify. A knife that is in substantially elliptical contact with the peripheral impression is then used to skive excess plastic from the rotating molding wheel, i.e., the layer of controlled film, leaving plastic only in the molding cavities. After the skiving process, the continuously connected fastener stock is removed, in-line, from the cavities in the molding wheel. Transfer rolls advance the fastener stock typically to a stretching station where selected portions of the fastener stock are selectively distended, e.g., using diverging sprocket wheels. After the stretching process, the fastener stock is collected onto a windup roll for packaging.

Typically, the practice of at least partially separating an individual fastener 10 from a supply of fastener stock 32 and, in turn, inserting the individual fastener through a tag 12 and into an article of commerce 14 is achieved using a hand-held apparatus commonly referred to as a tagger gun. Examples of tagger guns are disclosed in the McCarthy patent and the Russell patent.

The practice of using a tagger gun to secure a tag 12 to an article of commerce 14 is typically accomplished in the following procedure. The supply of fastener stock 32 is loaded into the tagger gun. The tagger gun includes a needle having a sharpened tip, which is inserted through the tag and into the article of commerce. An ejector rod in the tagger gun is then activated, for example, through the compression of a trigger, which, in turn, ejects the crossbar 18 first through the tag and then the article of commerce, thereby disposing the crossbar and the paddle 22 on opposite sides of the article of commerce with the tag slidably disposed onto the filament 24 of the fastener 10. As noted above, the paddle is appropriately sized and shaped to keep the tag from being pulled off the filament portion of the fastener.

Staples:

A staple is a second example of a fastening assembly, which is dispensed from continuously connected stock that is formed from the following items: two elongated and continuous side members coupled together by a plurality of equidistantly-spaced cross-links. The common name for this type of continuously connected stock is "ladder stock," and examples of which are described in U.S. Pat. No. 4,039,078 to Bone, which is incorporated by reference herein in its entirety. The individual staples have an H-shape and are dispensed from the fastener stock by cutting the side members at appropriate points between cross-links. The continuously connected stock that includes the staples can be made from plastic using the previously discussed continuous molding process, and can be dispensed using a tagger gun.

Figure 4:
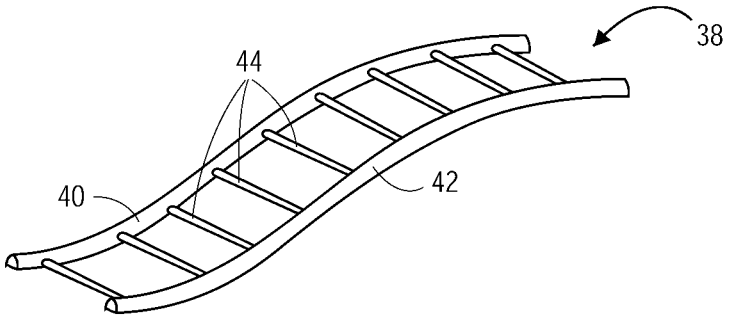
FIG. 4 is a perspective view of an example length of a continuously connected stock of plastic staples.

Referring now to FIG. 4, there is shown a perspective view of a length of conventional continuously connected fastener stock 38 that includes two elongated and continuous side members 40 and 42. The side members are coupled together by a plurality of equidistantly spaced, flexible cross-links or filaments 44. By cutting the side members at appropriate points between cross-links, individual plastic staples, which have an H-shape, are produced.

Figure 5:
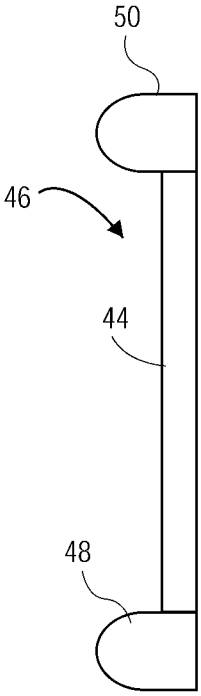
FIG. 5 is an enlarged end plan view of an example individual plastic staple obtained from the length of the continuously connected stock of FIG. 4.
Figure 6:
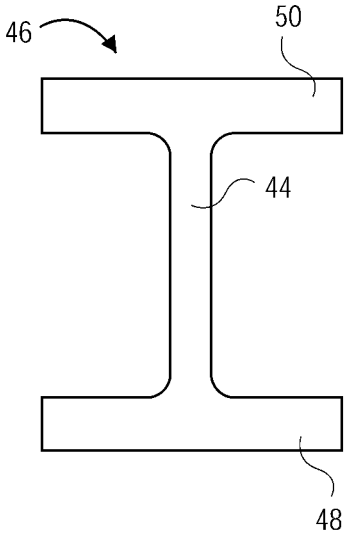
FIG. 6 is an enlarged front plan view of the plastic staple of FIG. 5.

Referring additionally to FIG. 5, there is shown an enlarged end view of an individual staple 46 obtained in the aforementioned manner from a length of fastener stock 38. The staple includes a first crossbar 48, which has been cut from side member 40, and a second crossbar 50, which has been cut from side member 42, respectively. The first and second crossbars are interconnected by a flexible filament 44. A top plan view of the plastic staple is shown in FIG. 6.

Cable Ties

A cable tie, also known as a bundling tie and a harnessing device, is a third type of fastening assembly that typically is used to couple together a plurality of elongated objects, such as wires or cables. One type of exemplary cable tie includes the following items: an elongated strap having an apertured head at one end. Typically, the opposite end of the elongated strap is shaped to define another item, a tail of narrowed width that is adapted for insertion through the apertured head to form a closed loop. A plurality of serrations or teeth is formed along the length of the elongated strap, and an internal pawl (or locking tang) is located within the apertured head. The internal pawl is adapted to prevent a serration on the strap, once inserted past the internal pawl, from being withdrawn. In this manner, the engagement of the internal pawl with the serrated strap is used to lock the cable tie in a closed-loop configuration. Examples of cable ties of the above construction are disclosed in the following U.S. patents, all of which are incorporated by reference herein in their entireties: U.S. Pat. Nos. 4,658,478 and 4,754,529 to Paradis, U.S. Pat. No. 5,593,630 to Sorensen et al., and U.S. Pat. No. 5,669,111 to Rohaly.

Another type of exemplary cable tie differs from the above-described cable tie in that it includes an apertured or ladder-type strap, instead of a serrated strap. The head of the cable tie typically has a buckle-like shape and includes a tongue that is adapted to enter the apertures of the strap and to lock the strap in a fixed loop configuration. Examples of this type of cable tie are disclosed in the following U.S. patents, all of which are incorporated by reference herein in their entireties: U.S. Pat. No. 3,766,608 to Fay, U.S. Pat. No. 4,347,648 to Dekkers, and U.S. Pat. No. 4,866,816 to Caveney.

Cable ties, whether of the serrated-strap variety or of the ladder-strap variety, both described above, typically are formed from plastic by injection molding. More specifically, this typically involves the use of a two-piece mold into which the impression of one or more whole cable ties has been formed. Molten plastic is injected into the mold through a single opening or gate in the mold until the one or more impressions within the mold are filled. The molten plastic is then allowed to harden in the one or more impressions, and then, the cable ties are removed from the mold.

Figure 7:
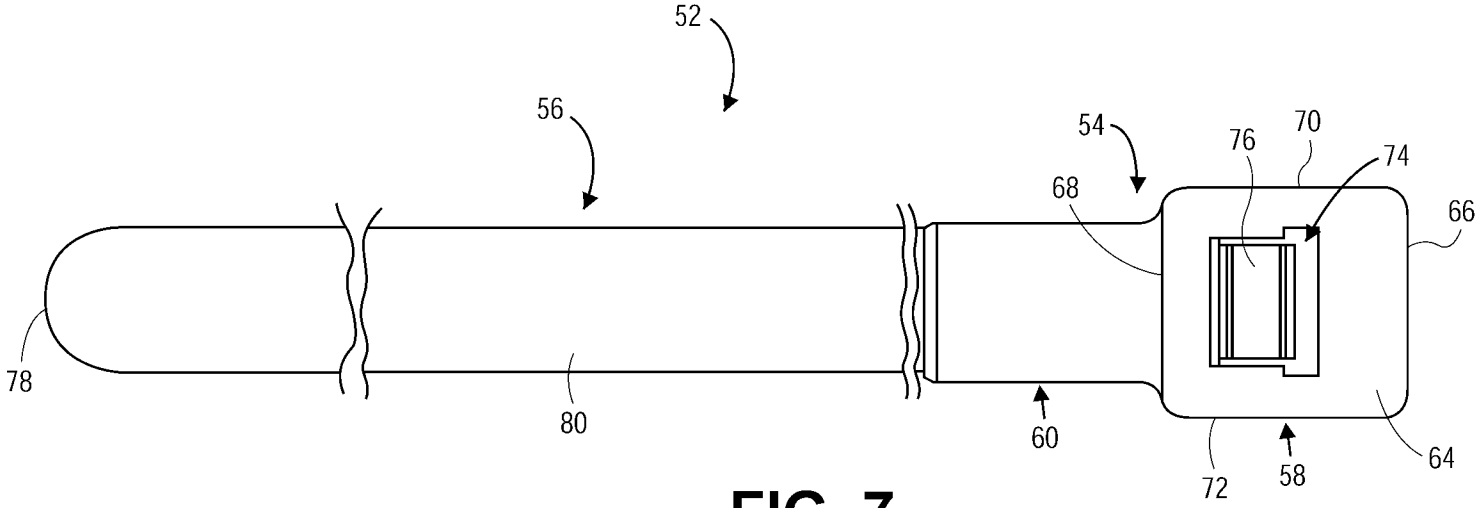
FIG. 7 is a top plan view of an example cable tie.
Figure 8:
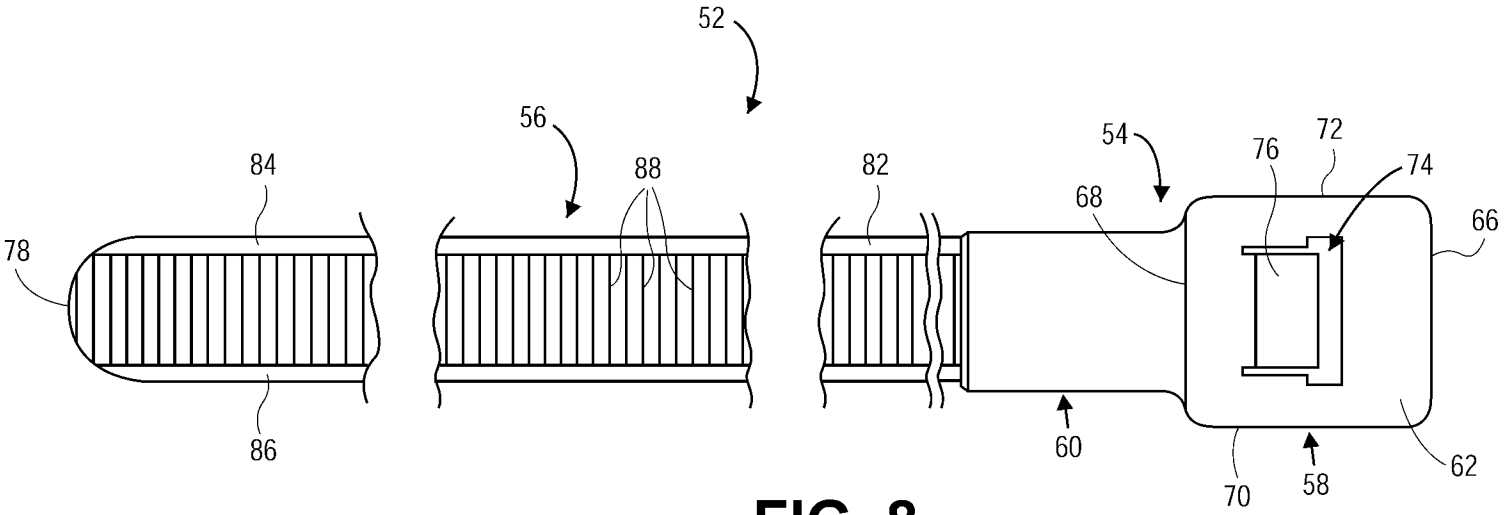
FIG. 8 is a bottom plan view of the cable tie of FIG. 7.

Referring now to FIGS. 7 and 8, an example embodiment of a cable tie 52 is shown. The cable tie includes a front portion 54 and a strap 56. The front portion includes a head 58 and a neck 60. The head generally is rectangular in shape and includes a bottom wall 62, a top wall 64, a front wall 66, a rear wall 68, a left side wall 70, a right side wall 72, and an elongated channel 74, which extends through the head from the bottom wall to the top wall. Furthermore, the head is shaped to include a locking tang 76 that extends into the channel. The tang is similar in shape and function to the tang described in U.S. Pat. No. 4,754,529 to Paradis.

The strap 56, which is generally rectangular, is an elongated flexible member that is shaped to include a tail 78 of narrowed width that is configured to be inserted through the channel 74 to form a closed loop. In addition, the strap is shaped to include a top surface 80 and a bottom surface 82, with the bottom surface shaped to include a pair of spaced-apart longitudinally extending rails 84 and 86 and a plurality of teeth 88 laterally extending between the rails. The teeth are configured to lockably engage the tang 76 so as to lock the cable tie 52 in a closed loop configuration.

Water-Soluble Material:

In the present invention, the material from which a fastening assembly, e.g., the fastener 10, staple 46, or cable tie 52, or any item or any portion of an item (where the item can include one or more portions) that is included in the fastening assembly, is made of, or includes, a water-soluble material, e.g., PVOH, a PVOH-based polymer, EVOH, or an EVOH-based polymer, instead of a non-water-soluble polymer, e.g., PU, PP, and PA. A water-soluble material is a material that dissolves or weakens in the presence of water. Accordingly, the entire fastening assembly or just the portion(s) of the fastening assembly that are made of a water-soluble material can dissolve or weaken after exposure to water.

The rate at which the water-soluble material dissolves or weakens is, in part, a function of the temperature of the liquid that includes the water (the liquid that includes the water can be pure water or a liquid that includes water as part of a mixture). For instance, in most cases, a water-soluble material will dissolve or weaken at a faster rate in a liquid that includes water having a temperature at or above a threshold temperature, and will dissolve or weaken at a slower rate in a liquid that includes water having a temperature below the threshold temperature. In one example embodiment, the threshold temperature is approximately +60° C. In this example embodiment, the fastening assembly, or portion(s) of the fastening assembly, can be configured to dissolve or weaken at a slower rate at lower temperatures, e.g., below approximately +60° C., and dissolve or weaken more rapidly at elevated temperatures, e.g., for temperatures at or above approximately +60° C. The lower temperature/slower dissolving/weakening rate allows the fastening assembly or portion(s) thereof to remain in place and provide sufficient bonding/coupling strength. In other example embodiments, the threshold temperature has a value from approximately +25° C. to approximately +100° C., from approximately +40° C. to approximately +100° C., from approximately +50° C. to approximately +100° C., or from approximately +60° C. to approximately +100° C. Fastening assembly removal occurs when the fastening assembly is exposed to liquid that includes water having an elevated temperature, which results in the fastening assembly dissolving/weakening at a faster rate. In an example embodiment, the fastening assembly or portion(s) thereof will dissolve/weaken in a liquid that includes water having an elevated temperature, e.g., a temperature at or above a threshold temperature, in less than a period of time, e.g., up to approximately 60 minutes, up to approximately 40 minutes, or up to approximately 20 minutes.

In other example embodiments, the fastening assembly or portion(s) thereof is configured to be exposed for a first period of time to a liquid that includes water (also referred to as the first liquid) at first temperature that is below the threshold temperature, so the fastening assembly or portion(s) thereof do not completely dissolve or weaken. Afterwards, the fastening assembly or portion(s) thereof is exposed for a second period of time to another liquid that includes water (also referred to as the second liquid, which can be the same as the first liquid) at a second temperature that is at or above the threshold temperature, which results in the fastening assembly or portion(s) thereof dissolving or weakening completely. In some example embodiments, the first period of time equals the second period of time. Also, in example embodiments, the second liquid is the same liquid as the first liquid. For example, there may be instances where it is advantageous to have a fastening assembly remain coupled to an article of commerce during a first washing process (e.g., a wash process in which the fastening assembly is exposed to a liquid that includes water at a first temperature for a first period of time), and then dissolve during a second washing process (e.g., another wash process in which the fastening assembly or portion(s) thereof is exposed to a liquid that includes water at a second temperature and for a second period of time). The first washing process can be done at the same or another location from where the second washing process occurs. In one example embodiment, a portion of the fabric of a pair of jeans is bunched and held together with a fastening assembly. The fastening assembly holds the fabric in this bunched configuration during a washing process. Next, after the washing process is completed, the jeans and the fastening assembly are exposed to a liquid that includes water having a high enough temperature (at or above the threshold temperature) and for a sufficient length of time to cause the fastening assembly to dissolve or weaken.

Fastening assemblies, or portion(s) of a fastening assembly, made of water-soluble materials, e.g., PVOH, a PVOH-based polymer, EVOH, or an EVOH-based polymer, are advantageous in that they are configured to dissolve or weaken, and thus, do not require the need for manual removal of the fastening assembly. For example, a manufacturer of a piece of apparel, e.g., a pair of jeans, can dissolve a fastening assembly or a portion(s) thereof that binds the piece of apparel to another piece of apparel or something else, merely by exposing the fastening assembly or portion(s) thereof to a liquid that includes water. The fastening assembly or portion(s) thereof can be exposed to a liquid that includes water when the apparel is washed. No additional labor is required to cut and/or remove the fastening assembly because the fastening assembly or portion(s) thereof dissolves or weakens. Thus, use of fastening assemblies having water-soluble materials advantageously result in reduced manufacturing labor costs.

Figure 9:
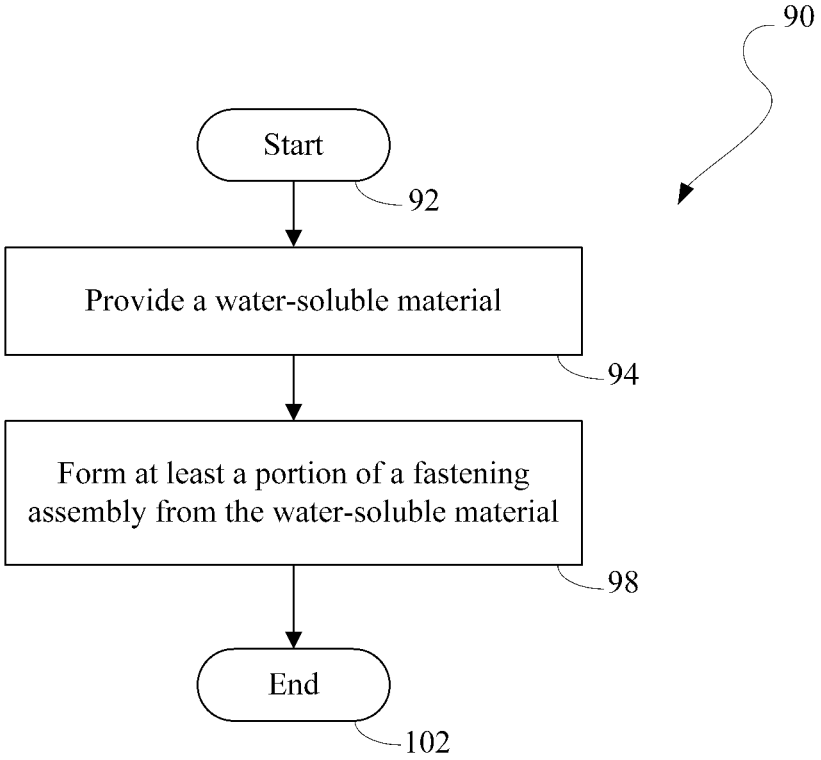
FIG. 9 is a flowchart for an example method of manufacturing a fastening assembly according to the invention.
Figure 10:
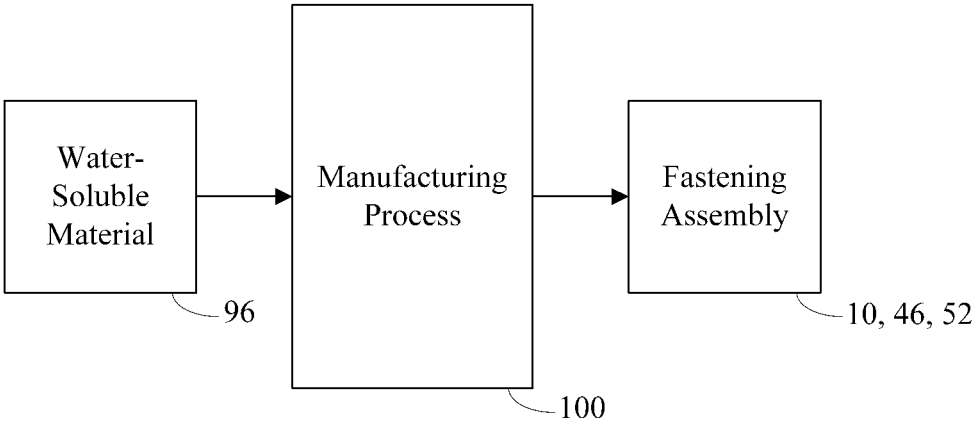
FIG. 10 is a block diagram that illustrates a water-soluble material being input to a manufacturing process, which, in turn, forms the water-soluble material into a fastening assembly.

Referring additionally to FIGS. 9 and 10, an exemplary method for manufacturing a fastening assembly 10, 46, and 52 according to the present invention is illustrated in the algorithm 90 of FIG. 9. After starting the method at step 92, the next step 94 is to provide a water-soluble material 96. Next, at step 98, the water-soluble material is formed, as part of the manufacturing process 100, into at least a portion of a fastening assembly. The method ends at step 102.

Figure 11:
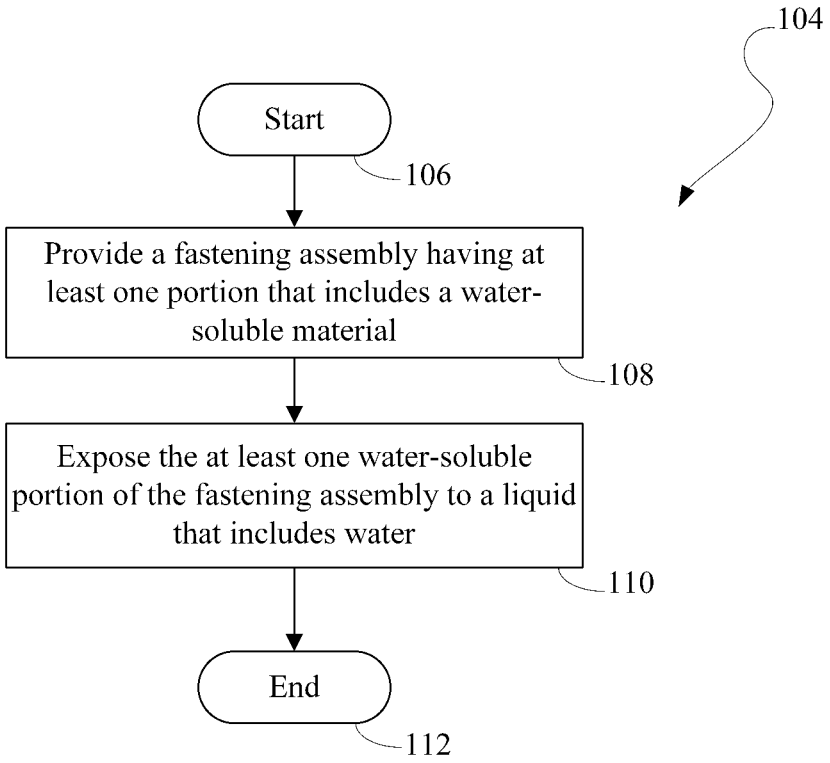
FIG. 11 is a flowchart for an example method of dissolving or weakening a fastening assembly according to the invention.

Referring additionally to FIG. 11, an exemplary method for dissolving or weakening at least a water-soluble portion of a fastening assembly 10, 46, and 52 according to the present invention is illustrated in the algorithm 104 of FIG. 11. After starting the method at step 106, the next step 108 is to provide a fastening assembly having at least one water-soluble portion that includes a water-soluble material 108. Next, at step 110, the at least one water-soluble portion of the fastening assembly is exposed to a liquid that includes water. The method ends at step 112.

All features disclosed in the specification, including the claims, abstract, and drawings, and all of the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined only by the following claims.

We claim:

1. A fastening assembly comprising an item made of a water-soluble material wherein the item does not completely dissolve or weaken within a first period of time when the item is exposed to a liquid that includes water having a temperature below a threshold temperature; wherein the item completely dissolves within a second period of time when the item is exposed to a liquid that includes water having a temperature at or above a threshold temperature and wherein the fastening assembly is selected from the group consisting of a fastener, a staple, and a capable tie.

2. The fastening assembly according to claim 1, wherein the water-soluble material is selected from the group consisting of polyvinyl alcohol, a polyvinyl alcohol based polymer, ethylene vinyl alcohol, and an ethylene vinyl alcohol based polymer.

3. The fastening assembly according to claim 1, wherein the item is configured to dissolve or weaken at a faster rate when the item is exposed to a liquid that includes water having a temperature at or above the threshold temperature, than when the item is exposed to the liquid that includes water having a temperature below the threshold temperature.

4. The fastening assembly according to claim 1, wherein the second period of time is up to approximately 60 minutes.

5. The fastening assembly according to claim 1, wherein the second period of time is up to approximately 40 minutes.

6. The fastening assembly according to claim 1, wherein the second period of time is up to approximately 20 minutes.

7. The fastening assembly according to claim 1, wherein the threshold temperature is up to approximately +60° C.

8. The fastening assembly according to claim 1, wherein the threshold temperature has a value from approximately +25° C. to approximately +100° C.

9. The fastening assembly according to claim 1, wherein the threshold temperature has a value from approximately +40° C. to approximately +100° C.

10. The fastening assembly according to claim 1, wherein the threshold temperature has a value from approximately +50° C. to approximately +100° C.

11. The fastening assembly according to claim 1, wherein the threshold temperature has a value from approximately +60° C. to approximately +100° C.

12. The fastening assembly according to claim 1, wherein the item is selected from the group consisting of a paddle, a crossbar, a filament, a strap, a head, a neck, a tang, a rail, a tooth, and combinations of the forgoing.

13. The fastening assembly according to claim 1, wherein the fastening assembly is a fastener or a staple and the item comprises a filament.

14. A fastening assembly comprising an item having at least one water-soluble portion and at least one water insoluble portion wherein the at least one water-soluble portion does not completely dissolve or weaken within a first period of time when the at least one water-soluble portion is exposed to a liquid that include water having a temperature below a threshold temperature and wherein the at least one water-soluble portion completely dissolves within a second period of time when the at least one water-soluble portion is exposed to a liquid that includes water having a temperature at or above a threshold temperature; and wherein the fastening assembly is selected from the group consisting of a fastener, a staple, and a cable tie, and the item is selected from the group consisting of a paddle, a crossbar, a filament, a strap, a head, a neck, a tang, a rail, a tooth, and combinations of the forgoing.

15. The fastening assembly according to claim 14, wherein the at least one water-soluble portion includes a material selected from the group consisting of polyvinyl alcohol, a polyvinyl alcohol based polymer, ethylene vinyl alcohol, and an ethylene vinyl alcohol based polymer.

16. The fastening assembly according to claim 14, wherein the at least one water-soluble portion is configured to dissolve or weaken at a faster rate when the at least one water-soluble portion is exposed to a liquid that includes water having the temperature at or above a threshold temperature, than when the at least one water-soluble portion is exposed to the liquid that includes water having a temperature below the threshold temperature.

17. The fastening assembly according to claim 14, wherein the at least one water soluble portion comprises a filament.

* * * * *